United States Patent [19]

McCarty

[11] 4,031,745

[45] June 28, 1977

[54] METHOD OF FORMING CONSTRICTION IN TUBING

[75] Inventor: William J. McCarty, Louisville, Ky.

[73] Assignee: General Electric Company, Louisville, Ky.

[22] Filed: Feb. 20, 1976

[21] Appl. No.: 659,768

[52] U.S. Cl. ..... 72/367; 29/157.4; 113/116 UT; 113/118 V

[51] Int. Cl.[2] ..... B21D 31/06

[58] Field of Search ..... 72/367; 29/157.4; 113/116 UT, 118 V, 118 R

[56] References Cited

UNITED STATES PATENTS

| | | | |
|---|---|---|---|
| 1,392,658 | 10/1921 | Roesch | 29/157 R X |
| 1,711,270 | 4/1929 | Litle, Jr. | 29/157 C |
| 2,225,513 | 12/1940 | Summers | 138/26 |
| 2,261,028 | 10/1941 | Hopkins | 138/44 X |
| 2,427,685 | 9/1947 | Midtlyng et al. | 29/407 |
| 2,621,028 | 12/1952 | Newhall | 165/78 |
| 2,744,429 | 5/1956 | Seely | 29/157 R |
| 2,777,257 | 1/1957 | Johnson | 51/34 D |
| 2,909,196 | 10/1959 | Jeffreys, Jr. | 138/44 |
| 3,776,018 | 12/1973 | French | 72/367 |
| 3,967,489 | 7/1976 | Pohl et al. | 72/367 |

*Primary Examiner*—John E. Roethel
*Assistant Examiner*—Gus T. Hampilos
*Attorney, Agent, or Firm*—Frank P. Giacalone; Francis H. Boos

[57] ABSTRACT

The present invention provides a method of forming a flow restriction in a tube to be used as a capillary in a refrigeration system. The method includes providing at least one longitudinally disposed groove in the internal wall of the tube, shaping the tube longitudinally to a preselected configuration, and then squeezing a section of the tube while directing a fluid therethrough until the fluid reaches a preselected pressure.

3 Claims, 7 Drawing Figures

METHOD OF FORMING CONSTRICTION IN TUBING

BACKGROUND OF THE INVENTION

1. Field of the Invention

The present invention relates generally to the process of manufacturing a capillary tube for use in a refrigeration system, and more specifically, to the process of shaping a length of tube having at least one axially disposed groove longitudinally to a preselected axial configuration, and then squeezing the tubing in two stages, and at different speeds while passing a medium therethrough under pressure until substantially all of the medium passes through the groove, reaches a preselected pressure.

2. Description of the Prior Art

In providing capillary tubes that meet the proper restriction requirements of a particular refrigeration system, it has been customary practice to purchase readily available tubing from standard stock having the smallest inside or bore diameter, and then cutting it to the length that would provide the proper restriction needed for a particular application.

While this practice does provide a capillary tube having effective flow characteristics, the proper flow restriction, however, is determined by the length of tubing and not by a predetermined passageway or inside diameter dimension. To accommodate the relatively long capillary provided in this manner into the available cabinet space, it is often necessary to coil or shape it. This coiling and handling of the tube presents some hazards in that the relatively small diameter passageway of the tubing may be pinched and closed off during the handling and shaping.

U.S. Pat. No. 2,225,513—Sommers discloses a method of forming restrictors wherein a relatively straight length of tubing is provided with longitudinally formed grooves the deform it cross-sectionally to initially reduce its passageway. The deformed tube is then twisted while being maintained in a straight longitudinal configuration. During the twisting operation a gas under constant pressure is passed through the tube with the twisting operation being terminated when the gas reaches a desired pressure. While the Sommers patent does provide a capillary having a predetermined length, it is, however, formed in a straight line and in some instances would require its shaping to fit its free ends into engagement with the appropriate tube members to complete its connection into the refrigeration system. In fact, unless the open ends of the refrigeration system to which the capillary is to be connected are spaced to receive the straight length of capillary formed by the Sommers patent, it must when completed be shaped either to fit into the available spaces or to align its ends with the proper refrigeration tube connections.

In forming standard tubing of preselected lengths into capillaries having a precise restriction, the time involved in forming them is extremely important when related to mass production systems. When tubing is formed in a slow continuous squeezing or forming operation until the proper restriction is achieved it has been found uneconomical in that mass production schedules and volume commitments are difficult to maintain.

In forming capillaries from standard tubing, that is, tubing available as a stock item, the use of a single high speed continuous squeezing or forming operation has been found to be impractical in that the reaction time between the termination of a squeezing operation after the proper restriction is sensed or arrived at, is sufficient in some instances to cause an overshoot. This overshoot caused by the reaction time between the sensing of the proper restriction and the ability to stop a high speed machine results in an overly restricted tube or may in fact cause the passageway to be completely shut off, in which case it is then necessary as disclosed in U.S. Pat. No. 1,392,658 Roesch, to provide means and the additional step of reopening the closed passageway. To reopen the passageway and afford the precise slow characteristics required would present many of the same problems faced in prior art attempts and would not be economically feasible in meeting the mass production requirement.

In addition, it has been the experience in squeezing tubes with high speed equipment that the squeezed tube has a tendency to spring back. In effect, when a high speed operation or machine is brought to an abrupt stop at a precise preselected dimension the inability to accurately determined what the spring back qualities of the tube will be results in inaccurate restriction configuration.

Another method of manufacturing capillary tubes is disclosed in the pending patent application Ser. No. 577,710–Pohl et al. filed May 15, 1975 and assigned to General Electric Company, the assignee of the present invention. The Pohl application, of which the present invention is an improvement, discloses a method wherein a length of tubing is pre-shaped and a selected portion is squeezed in two steps until medium passing through the flattened squeezed portion reaches a predetermined pressure. The restriction in the tube member at the time the proper pressure is attained in effect is an extremely narrow slit which may be subject to clogging by foregoing objects that may be present in the refrigeration system.

SUMMARY OF THE INVENTION

By this invention there is provided a method of forming a capillary tube for connection into a refrigeration system. An axially disposed groove is formed on the internal wall of a length of tubing that is then formed longitudinally into a preselected configuration so that its free ends are adapted to be connected into the refrigeration system. A preselected portion of the formed tubing is placed in a two step forming mechanism. The tubing is then connected to a constant source of fluid whose pressure is recorded on a measuring device. An initial high speed squeezing operation crushes the tube to a predetermined passageway restriction wherein substantially all of the medium passes through the groove, and a second slower squeezing operation crushes the tubing further to deform the groove until the medium passing therethrough reaches a predetermined pressure, at which time the squeezing operation is terminated.

It is an object of the invention to provide an improved method of forming a capillary to be used in refrigeration systems.

It is another object of the method of this invention to produce a capillary from a standard readily available dimensioned tubing.

It is another object of the method of this invention to provide a tube having at least one longitudinally disposed groove on its inner wall and to employ a high speed first squeezing operation which is effective in providing a restriction through the groove that is substantially complete and then employing a second low speed operation that continues squeezing the tube to deform the groove until the final design restriction through the groove is attained.

It is still another object of the method of this invention that the restriction or final design passageway through the groove is large enough to allow passage of foreign objects that may normally be encountered in hermetic refrigeration systems.

DESCRIPTION OF THE PREFERRED EMBODIMENT

Figure 1:
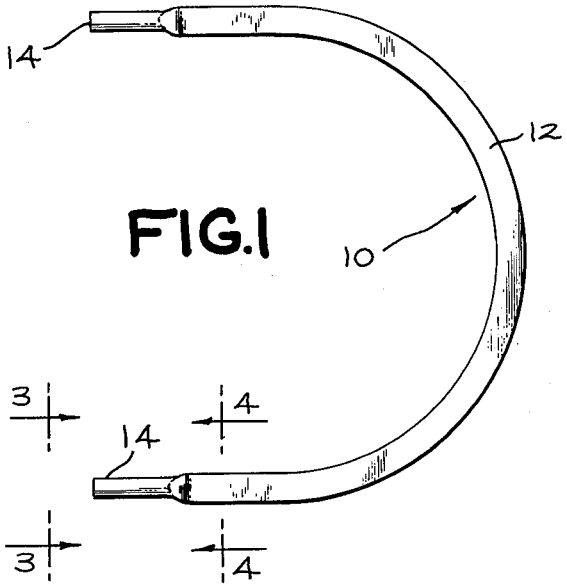
FIG. 1 is a plan view of the formed tubing incorporating the restriction formed by the method of the present invention.

Referring to the drawings and more particularly to FIG. 1, there is shown a capillary tube 10 formed in accordance with the method of the present invention. The finished tube 10 consists of a crushed or squeezed portion 12 including the restriction or capillary where, as will hereinafter be explained, passage therethrough is provided primarily by groove 11 and end portions 14.

The tubing 10 employed in the present method is a standard stock item and has an outside diameter of approximately ¼, a wall thickness of approximately 0.050, it should be noted that tubing having other dimensions may be employed, however, the following description of the method of the present embodiment has been carried out with the above dimensioned tube stock.

Figure 6:
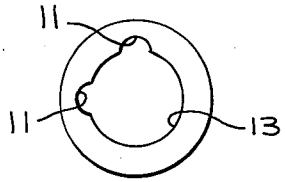
FIG. 6 shows a tube configuration of another embodiment.
Figure 7:
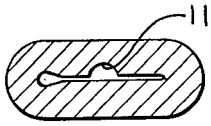
FIG. 7 shows the tube restriction of the embodiment of FIG. 6 in its final form.
Figure 3:
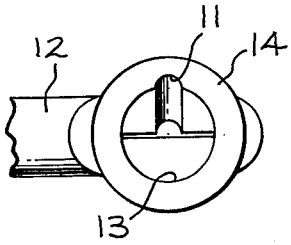
FIG. 3 is the end view of the tubing showing the preformed tube configuration.

The initial step in the present method of producing capillary tubes is to provide one or more axially or longitudinally disposed grooves 11 on the surface of the internal wall 13 of tube 10. Conveniently the groove 11 may be formed at the time the tube 10 is fabricated or extruded. The final restriction or passageway in the tube 10 is through the groove 11 and the exact constriction is provided by the two step squeezing operations and accordingly the exact configuration or dimension of the groove 11 is not critical. In some tube sizes it may be advantageous to provide more than one groove. FIG. 6 shows one arrangement wherein the grooves 11 are 90° apart and may end up as shown in FIG. 7 with one on the end of the slit with the other being substantially centrally located on the slit formed by the collapsed side wall 13.

Figure 2:
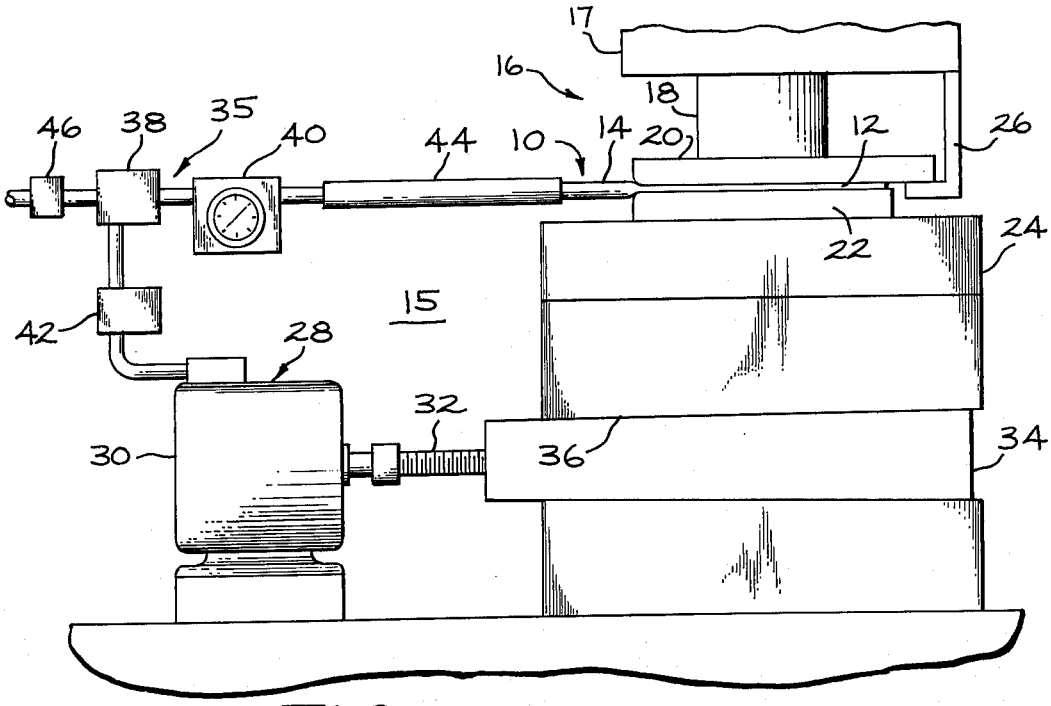
FIG. 2 is the mechanism used in carrying out the method of the present invention.

The squeezing or crimping operation of the present method of forming the capillary and restriction through groove 11 may be effected by several different mechanisms. One form of mechanism 15 for carrying out the steps of the method is shown in FIG. 2, wherein the mechanism includes a two step or operation, forming press 16 which may be of the hydraulic or direct mechanical drive type. The press 16 includes a primary or high speed section 17 which includes a forming ram 18 having a die plate 20 carried thereon. The die plate 20 is adapted to cooperatively engage with a matching die 22 supported on a table or anvil 24.

A stop means 26 is positioned so as to be engaged by the die 20 during its downward travel so that the movement of die 20 is arrested at a predetermined point relative to the anvil 24. Cooperating with the support table 24 is a secondary or slow speed squeezing means 28 for moving the die 22 toward the arrested die plate 20 located in engagement with the stop 26. The slow speed means 28 is employed to complete the forming operation of the restriction 12 of the tube 10 as will be hereinafter explained. To this end the secondary squeezing means 28 includes a drive member 30 which is connected to a wedged shaped member 34 through element 32. In operation, when the drive member 30 is activated it forces the member 34 through element 32 to the left in FIG. 2. Lateral movement of the member 34 is effective through its inclined surface 36 acting on a mating surface on table 24 to raise the die 22 thereon toward the stationary die plate 20. The element 32 may be driven laterally, or alternatively it may be a screw that is rotatably arranged between drive 30 and wedge 34 to laterally move the wedge member relative to the anvil 24. At the completion of the second squeezing operation the member 34 is returned to its normal position wherein the spacing of die 22 relative to the stop 26 is maintained.

In FIG. 2 there is also shown as a part of the mechanism 15 used in carrying out the present method, one control means or arrangement 35 for supplying fluid or air under pressure to the tube 10 to be formed and for controlling the operation of the steps of the present method. Fluid or air under regulated pressure is conducted from a source (not shown) to a common pressure regulator 46. The discharge side of the regulator 46 is connected to a pressure or flow switch 38. The rate of air flow may, as will be explained hereinafter, be preset and controlled by the flow switch 38. From the flow switch 38 air is directed to the tubing 10 to be formed through a gauge 40 which provides a visual indication of the fluid pressure.

The flow switch 38 is connected to the secondary squeezing mechanism 28 whose operation is initiated by the flow switch 38 after, as will be explained hereinafter, the capillary passageway is initially decreased by movement of ram 18 of the first or high speed squeezing operation.

Figure 5:
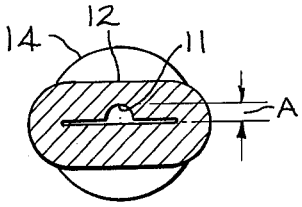
FIG. 5 shows the tube restriction at its intermediate stage.

The flow switch 38 can be appropriately calibrated to initiate the second squeezing mechanism 28 when the pressure of the fluid in the tube restriction reaches a predetermined pressure between desired limits or, when the cross sectional area is dimensioned as shown in FIG. 5 as determined by the position of stop 26 relative to anvil 24. In either case at the completion of the first or high speed operation the restriction at that time is substantially complete as indicated by dimension "A" in FIG. 5 relative to dimension "B" in the final form shown in FIG. 4.

Figure 4:
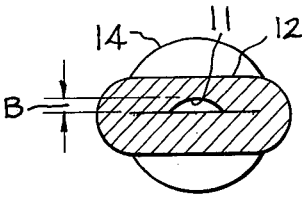
FIG. 4 is a view taken along lines 4—4 of FIG. 1 showing the tube restriction in its final form.

More specifically, as shown in FIG. 5 which represents the tube configuration at the end of the first or high speed squeezing operation the inner tube wall 13 is collapsed in a flat slit, and accordingly substantially all of the fluid flow through tube 10 may be through the groove 11. The following slow speed or second operation in effect may then act to deform the groove 11 as shown in FIG. 4 until the desired restricted flow of the capillary is achieved.

As mentioned hereinbefore, the exact configuration and size of groove 11 is not critical, however, it nevertheless must be large enough that the cross sectional area remaining after the final predetermined pressure flow is arrived at is between 0.0005 and 0.003 square inches which should be sufficient to allow the passage of foreign objects that may be normally associated with a sealed refrigeration system.

The starting and stopping of mechanism 28 may be determined by the predetermined pressure settings of the flow control switch 38 so that very exact passageway restrictions can be obtained, this is especially true as carried out in the present embodiment wherein the speed of the die 22 is between 0.001 and 0.010 inches per second.

It should be further understood that the second or slow speed stages of the squeezing operation may be a variable speed. For example, a servo mechanism 42 may be serially connected between the flow switch 38 and mechanism 28. The servo mechanism 42 would be effective to initiate mechanism 28 at a preselected speed at the start of the second operation and then be effective in slowing down the operation of the mechanism 28 from the preselected speed as the pressure in the tube restriction increases as the tubing approaches its designed constriction.

In carrying out the present method of forming capillaries, a preselected length of tube section 10 provided with the groove 11 is preshaped so that its free ends 14 are adapted to be connected into a refrigeration system, customarily intermediate the evaporator and condenser. While in FIG. 1 the formed tube is shown as being substantially U-shaped and relatively flat, or in a single plane, it should be noted that various other shapes and configurations are adaptable in carrying out the present method.

In preforming the tube 10 it is, however, necessary that at least one relatively flat portion or section having its axis in a single plane be provided that may be conveniently arranged between dies 20 and 22 and subsequently formed or squeezed to provide the restriction in accordance with the present method. In effect the axis of the portion of the tube 10 exterior of section 12 to be formed with the capillary may be angled laterally therefrom in any convenient direction that may be necessary to adapt the tube 10 into an available area.

After the tube 10 is preformed or shaped as mentioned hereinbefore, the flat portion or area 12 thereof to be squeezed is arranged between the dies 20, 22 of the press 16. One of the free ends 14 of tube 10 is then connected to the control means 35 through a conduit 44. With section 12 of the tube 10 so positioned, the high speed section 17 of press 16 is activated to initiate the first squeezing step so that ram 18 and its die 20 is moved rapidly toward die 22 until it is arrested by stop means 26. At the completion of the first squeezing operation the second slower squeezing operation may be initiated and then terminated by flow switch 38 when a predetermined pressure flow is measured to complete the forming of the restriction.

While, as mentioned hereinbefore, it is not desirable to form the restriction by a high speed squeezing operation because of the difficulty in controlling a high speed press, it is, however, advantageous to use a high speed squeezing operation to bring the restriction and more specifically the groove 11 relatively close to the final design dimension so that the final or slow speed squeezing operation or movement of die 22 requires a minimum amount of travel and as a result the total forming operation of the capillary time is held to a minimum.

It should be noted that the first or high speed squeezing operation may be terminated by fllow switch 38 of the control means 35 similar to the second or slower operation when the pressure flow through the tube 10 and groove 11 reaches a first predetermined pressure, at which time the second or slow speed squeezing operation may be initiated by control means 35 as mentioned hereinabove. This second or slow speed operation would then continue to deform the tube 10 and groove 11 until the pressure flow through the tube and groove 11 reaches a second or final predetermined pressure, at which time the flow switch 38 terminates operation of the mechanism 15.

It should be apparent to those skilled in the art that the embodiment described heretofore is considered to be the presently preferred form of this invention. In accordance with the patent statutes, changes may be made in the disclosed apparatus and the manner in which it is used without actually departing from the true spirit and scope of this invention.

I claim:

1. The method of forming a capillary tube for connection into a refrigeration system which comprises:

forming at least one longitudinally disposed groove in the internal wall of a length of tubing;

forming said length of tubing longitudinally into a preselected configuration so that the free ends thereof are arranged to connect with said refrigeration system, including at least one portion intermediate said ends being in a single plane;

placing said portion of said tubing intermediate said free ends in a forming means;

connecting at least one of said free ends to a source of constant pressure through a control means having means for measuring said pressure passing through said tubing;

squeezing said portion of the tubing in the forming means at a first speed until the tubing reaches an intermediate predetermined restriction; then squeezing said portion of tubing at a second slower speed so that substantially all of the medium passing through said tubing travels through said groove, and continuing said slower speed squeezing until the groove restriction causes the medium passing therethrough to reach a final predetermined pressure; and terminating said second squeezing operation when said measuring means indicates said predetermined pressure.

2. The method of claim 1 wherein said intermediate predetermined restriction is between 90% and 99% of final predetermined restriction.

3. The method of claim 1 wherein said groove in the completed capillary has a cross sectional area of between 0.0005 and 0.003 square inches.

* * * * *